US010373477B1

(12) United States Patent
Bonner et al.

(10) Patent No.: US 10,373,477 B1
(45) Date of Patent: Aug. 6, 2019

(54) HYGIENE COMPLIANCE MODULES FOR DISPENSERS, DISPENSERS AND COMPLIANCE MONITORING SYSTEMS

(71) Applicant: GOJO Industries, Inc., Akron, OH (US)

(72) Inventors: Chet J. Bonner, Independence, OH (US); Jackson W. Wegelin, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/717,058

(22) Filed: Sep. 27, 2017

Related U.S. Application Data

(60) Provisional application No. 62/400,789, filed on Sep. 28, 2016, provisional application No. 62/400,800, filed on Sep. 28, 2016, provisional application No. 62/400,825, filed on Sep. 28, 2016.

(51) Int. Cl.
*G08B 23/00* (2006.01)
*G08B 21/24* (2006.01)
*A47K 5/12* (2006.01)

(52) U.S. Cl.
CPC ..... *G08B 21/245* (2013.01); *A47K 5/12* (2013.01)

(58) Field of Classification Search
CPC ..... G08B 21/245; A47K 5/12
USPC ..... 340/573.1
See application file for complete search history.

(56) References Cited

U.S. PATENT DOCUMENTS

| | | | |
|---|---|---|---|
| 3,576,277 | A | 4/1971 | Blackman |
| 3,768,732 | A | 10/1973 | Curtis et al. |
| 4,274,409 | A | 6/1981 | Bush |
| 4,274,558 | A | 6/1981 | Clausen |
| 4,352,444 | A | 10/1982 | Lewis et al. |
| 4,535,813 | A | 8/1985 | Spain |
| 4,563,780 | A | 1/1986 | Pollack |
| 4,606,085 | A | 8/1986 | Davies |
| 4,673,109 | A | 6/1987 | Cassia |
| 4,722,372 | A | 2/1988 | Hoffman et al. |
| 4,880,149 | A | 11/1989 | Scholefield et al. |
| 4,896,085 | A | 1/1990 | Jones |

(Continued)

FOREIGN PATENT DOCUMENTS

| | | | |
|---|---|---|---|
| DE | 29918082 | U1 | 3/2000 |
| EP | 2223642 | A2 | 9/2010 |

(Continued)

*Primary Examiner* — Zhen Y Wu
(74) *Attorney, Agent, or Firm* — Calfee, Halter & Griswold LLP

(57) ABSTRACT

Compliance modules for fluid dispensers are disclosed herein. Exemplary embodiments of the compliance modules include a housing, a processor, memory, wireless communication circuitry and voltage monitoring circuitry for detecting a change in voltage of a dispenser power supply. The processor, memory and voltage monitoring circuitry are located within the housing. A connector for electrically connecting the module to a power supply of the dispenser is also included. The compliance module receives power from the dispenser. The processor determines a dispense event has occurred as a function of a change in voltage detected by the voltage monitoring circuitry. The processor causes the wireless communication circuitry to transmit a signal indicative of a dispense event.

11 Claims, 10 Drawing Sheets

(56) References Cited

U.S. PATENT DOCUMENTS 4,896,144 A 1/1990 Bogstad
4,921,150 A 5/1990 Lagergren et al.
4,946,070 A 8/1990 Albert et al.
4,946,072 A 8/1990 Albert et al.
4,967,935 A 11/1990 Celest
4,989,755 A 2/1991 Shiau
5,014,884 A 5/1991 Wunsch
5,028,972 A 8/1991 Muderlak et al.
5,086,526 A 2/1992 Van Marcke
5,098,666 A 3/1992 Meinz
5,105,992 A 4/1992 Fender et al.
5,217,035 A 6/1993 Van Marcke
5,243,717 A 9/1993 Yasuo
5,244,367 A 9/1993 Aslin
5,249,706 A 10/1993 Szabo
5,305,916 A 4/1994 Suzuki et al.
5,329,117 A 7/1994 Gahili et al.
5,344,047 A 9/1994 Chen
5,379,917 A 1/1995 Brown et al.
5,385,464 A 1/1995 Anderson
5,477,984 A 12/1995 Sayanna et al.
5,487,877 A 1/1996 Choi
5,492,247 A 2/1996 Shu et al.
5,611,465 A 3/1997 Lee et al.
5,626,908 A 5/1997 Shaw
5,739,596 A 4/1998 Takizawa et al.
5,761,818 A 6/1998 Hopkins et al.
5,772,291 A 6/1998 Byrd et al.
5,808,553 A 9/1998 Cunningham
5,824,407 A 10/1998 Hayashi et al.
5,829,072 A 11/1998 Hirsch et al.
5,836,482 A 11/1998 Ophardt et al.
5,855,356 A 1/1999 Fait
5,857,589 A 1/1999 Cline et al.
5,865,226 A 2/1999 Sweeney
5,868,311 A 2/1999 Cretu-Petra
5,870,015 A 2/1999 Hinkel
5,904,054 A 5/1999 Lee
5,908,140 A 6/1999 Muderlak et al.
5,909,830 A 6/1999 Bates et al.
5,943,712 A 8/1999 Van Marcke
5,945,910 A 8/1999 Gorra
5,966,753 A 10/1999 Gauthier et al.
5,999,106 A * 12/1999 Buckler ..... B05C 5/0225 340/606
6,036,056 A 3/2000 Lee et al.
6,038,331 A 3/2000 Johnson
6,039,212 A 3/2000 Singh
6,065,639 A 5/2000 Maddox et al.
6,142,339 A 11/2000 Blacker et al.
6,206,238 B1 3/2001 Ophardt
6,209,751 B1 4/2001 Goodin et al.
6,209,752 B1 4/2001 Mitchell et al.
6,236,317 B1 5/2001 Cohen et al.
6,268,771 B1 7/2001 Bearfield
6,276,565 B1 8/2001 Parsons et al.
6,279,777 B1 8/2001 Goodin et al.
6,293,428 B1 9/2001 Chen
6,343,724 B1 2/2002 Ophardt et al.
6,375,038 B1 4/2002 Daansen et al.
6,390,329 B1 5/2002 Maddox
6,398,513 B1 6/2002 Amsler et al.
6,467,651 B1 10/2002 Muderlak et al.
6,551,739 B1 4/2003 Chen
6,651,851 B2 11/2003 Muderlak et al.
6,695,246 B1 2/2004 Elliott et al.
6,710,606 B2 3/2004 Morris
6,826,455 B1 11/2004 Iott et al.
6,977,588 B2 12/2005 Schotz et al.
7,374,066 B2 5/2008 Jackson et al.
RE40,588 E 11/2008 Ostendorf et al.
7,611,030 B2 11/2009 Reynolds et al.
7,615,970 B1 11/2009 Gimlan
7,621,426 B2 11/2009 Reynolds et al.
7,737,581 B2 6/2010 Spurlin et al.
7,909,209 B2 3/2011 Kanfer
8,085,155 B2 12/2011 Prodanovich et al.
8,100,299 B2 1/2012 Phelps et al.
8,302,812 B2 11/2012 Reynolds
8,350,706 B2 1/2013 Wegelin et al.
8,385,093 B2 2/2013 Trattler et al.
8,558,701 B2 10/2013 Wegelin et al.
8,573,447 B2 11/2013 Muderlak et al.
8,717,177 B2 5/2014 Cartner
8,816,536 B2 8/2014 Borke et al.
8,823,525 B2 9/2014 Cartner et al.
8,847,752 B2 9/2014 Wegelin et al.
8,960,498 B2 2/2015 Wegelin et al.
9,131,811 B2 9/2015 Wegelin et al.
9,172,266 B2 10/2015 Curtis et al.
9,349,274 B2 5/2016 Wegelin et al.
9,357,888 B2 6/2016 Wegelin et al.
9,633,543 B2 4/2017 Wegelin et al.
9,633,544 B2 4/2017 Wegelin et al.
9,633,545 B2 4/2017 Wegelin et al.
2001/0013767 A1 8/2001 Takemoto
2001/0023876 A1* 9/2001 Estelle ..... B05C 5/001 222/146.5
2004/0090333 A1 5/2004 Wildman et al.
2004/0226962 A1 11/2004 Mazursky et al.
2005/0189819 A1 9/2005 Maskatia et al.
2006/0124662 A1 6/2006 Reynold
2006/0231568 A1* 10/2006 Lynn ..... A47K 5/1202 222/52
2007/0053133 A1* 3/2007 Evans ..... H01F 7/1805 361/160
2007/0056993 A1 3/2007 Brown et al.
2008/0001763 A1 1/2008 Raja et al.
2008/0021779 A1* 1/2008 Lynn ..... G06Q 20/206 705/14.65
2008/0109956 A1 5/2008 Bayley et al.
2008/0185399 A1* 8/2008 Yang ..... A47K 5/1217 222/52
2009/0026305 A1 1/2009 Elliott et al.
2009/0069749 A1 3/2009 Miller et al.
2009/0301523 A1 12/2009 Barnhill et al.
2010/0017041 A1 1/2010 Bentivoglio
2010/0134296 A1* 6/2010 Hwang ..... A47K 5/1217 340/573.1
2010/0168926 A1 7/2010 Bayley et al.
2010/0188228 A1 7/2010 Hyland
2010/0282773 A1 11/2010 Ionidis
2010/0328076 A1 12/2010 Kyle et al.
2011/0056991 A1 3/2011 Brown et al.
2011/0169646 A1 7/2011 Raichman
2011/0193703 A1 8/2011 Payton et al.
2012/0031930 A1 2/2012 Fileccia et al.
2012/0067920 A1* 3/2012 Veltrop ..... B67D 3/0019 222/1
2012/0074894 A1 3/2012 Chea et al.
2012/0241470 A1* 9/2012 Snodgrass ..... A61L 2/0088 222/63
2013/0001250 A1 1/2013 Wegelin et al.
2013/0098940 A1* 4/2013 Bem ..... A47K 5/1217 222/1
2014/0054322 A1* 2/2014 McNulty ..... A47K 5/14 222/190
2014/0234140 A1* 8/2014 Curtis ..... A47K 5/1217 417/411
2014/0253336 A1* 9/2014 Ophardt ..... A47K 5/1202 340/573.1
2015/0313420 A1* 11/2015 Tramontina ..... A47K 5/1211 222/1
2016/0052007 A1* 2/2016 Fuller ..... B01F 5/061 222/1
2016/0274596 A1* 9/2016 Buell ..... A47K 5/12
2016/0309967 A1* 10/2016 Pelfrey ..... A47K 5/1217
2017/0136479 A1* 5/2017 Ophardt ..... A47K 5/1211

FOREIGN PATENT DOCUMENTS

GB 2244473 12/1991
GB 2256442 A 12/1992

(56) References Cited

FOREIGN PATENT DOCUMENTS

| | | | |
|---|---|---|---|
| JP | 200060764 | | 11/1998 |
| WO | 9012530 | | 11/1990 |
| WO | 200021178 | | 4/2000 |
| WO | 02094973 | A1 | 11/2002 |
| WO | 2008088424 | A1 | 7/2008 |
| WO | 2009134242 | A1 | 11/2009 |
| WO | 2014031816 | A1 | 2/2014 |

* cited by examiner

HYGIENE COMPLIANCE MODULES FOR DISPENSERS, DISPENSERS AND COMPLIANCE MONITORING SYSTEMS

RELATED APPLICATIONS

This application claims priority to and the benefits of U.S. Provisional Application Ser. No. 62/400,789 titled HYGIENE COMPLIANCE MODULES FOR DISPENSERS, DISPENSERS AND COMPLIANCE MONITORING SYSTEMS, which was filed on Sep. 28, 2016 and is incorporated herein by reference in its entirety. This application also claims priority to and the benefits of U.S. Provisional Application Ser. No. 62/400,800 titled HYGIENE COMPLIANCE MODULES FOR DISPENSERS, DISPENSERS AND COMPLIANCE MONITORING SYSTEMS, which was filed on Sep. 28, 2016 and is incorporated herein by reference in its entirety; and this application also claims priority to and the benefits of U.S. Provisional Application Ser. No. 62/400,825 titled HYGIENE COMPLIANCE MODULES FOR DISPENSERS, DISPENSERS AND COMPLIANCE MONITORING SYSTEMS, which was filed on Sep. 28, 2016 and is incorporated herein by reference in its entirety.

TECHNICAL FIELD

The present invention generally relates to compliance modules, dispensers with compliance modules and compliance monitoring systems. Particularly, the present invention relates to hygiene compliance modules that are capable of being inserted in existing dispensers to enable hygiene compliance monitoring functions.

BACKGROUND OF THE INVENTION

In hands-free (or touch-free) dispensers, a liquid or foam pump is activated by an actuator through a drive cycle to dispense a dose of fluid. Typically the drive actuator is powered by a direct current (DC) motor with a drive train formed of gears or other mechanical means. The drive train (including the motor) strokes or spins the pump.

The public's growing concern with disease and its transmission has generated increased public awareness regarding the need for sanitization and hygiene in general. In addition, various marketers in the hygiene industry believe that with increased public awareness and education, cleansing, and especially hand cleansing, will continue to be a subject of increasing scrutiny.

Whether it is the possible transmission of *E. coli* in the food services industry, healthcare acquired infection (HAI) related diseases within healthcare facilities, or even the transmission through ordinary physical contact made during a simple handshake, there are numerous studies citing proper hand hygiene as an effective way to guard against disease transmission. Indeed, the Center for Disease Control (CDC) concluded that hand washing is the single most important factor in the prevention of disease and in the reduction in the spread of infection.

Non-compliance with established hand washing protocols, in for example, food service industries, is a serious problem, which can lead to expensive and sometimes fatal consequences. Each year, food-borne illness strikes 76 million people, causes 325,000 hospitalizations, and kills thousands. In particular, 70% of the outbreaks originate in the food service sector and 40% of these outbreaks are the result of poor hand washing and cross-contamination (oral/fecal).

In addition, the CDC estimates that healthcare acquired infections (HAI) cost, on average, $35,000 per incidence from extended medical costs alone. The CDC also estimates that the occurrence of HAI infections can be reduced by one-third when infection control practices that include hand hygiene compliance measurement are implemented. That is, the CDC estimates that one third of all HAI infections are caused by poor adherence to infection control practices, such as hand washing. The CDC estimates that the annual costs to the public health system, personal pain and suffering, and lost productivity that result from food-borne illness and HAI infections are estimated to be as high as $83 billion annually. Approximately two million hospital patients annually become infected while being treated for another illness or injury, with approximately 120,000 of these patients dying. The CDC estimates that these infections or illnesses add nearly $4.5 billion to U.S. healthcare costs annually.

The monitoring of hand washing by individuals who are identified by electronic badges or data tags and then associating the badges or tags and individuals with the use of hygiene dispensers is known in the art. In addition, usage indicating or counting dispensers, such as that disclosed in U.S. Pat. No. 6,375,038, provide a soap or sanitizer dispenser having a usage indicator that tracks the number of times the dispenser has been used. Usage indicating or counting dispensers have experienced minor acceptance in the marketplace due to the burden of the manual recording and analysis of the count data from each dispenser. For example, a typical healthcare or food processing facility could have hundreds of dispensers and a similar number of individuals.

There are a number of automated system providers for hygiene compliance monitoring systems that use dispensers equipped with wireless communication circuitry for transmitting dispense events and user identification means to a central computer to record and analyze the usage data. Each of these systems utilize different types of communications protocols, transmitters, and the like. These automated system providers often use dispensers that are manufactured by one or more dispenser manufactures. Accordingly, for a dispenser manufacturer to work with all of the providers, the dispenser manufacturer must stock multiple dispensers, some equipped with compliance monitoring features for provider A, some equipped for provider B, etc. and may also stock some that are not equipped with compliance monitoring systems. Having multiple skews and products increases manufacturing complexity, increases required inventory, and the like, all of which drives up costs.

Several dispenser providers/system providers provide separate self-contained units that are mounted below the dispensers. The self-contained units sense an output and communicate that the dispenser has provided an output and may also identify an identifier indicative of the individual that received the output.

U.S. Pat. No. 8,558,701 discloses a compliance module with a connector that may be coupled to a dispenser through a communication port that has a dispense event signal and power at the communication port. However, not all dispensers have a dispense event signals and power at a communication port. In addition, not all dispensers have a communication port.

SUMMARY

Compliance modules for fluid dispensers are disclosed herein. Exemplary embodiments of compliance modules include a housing, a processor, memory, wireless communication circuitry and voltage monitoring circuitry for detecting a change in voltage of a dispenser power supply. The processor, memory and voltage monitoring circuitry are located within the housing. A connector for electrically coupling the module to a power supply of the dispenser is also included. The compliance module receives power from the dispenser. The processor determines a dispense event has occurred as a function of a change in a parameter, such as, for example, a change in voltage detected by the voltage monitoring circuitry. The processor causes the wireless communication circuitry to transmit a signal indicative of a dispense event.

Another exemplary compliance module for fluid dispensers includes a housing, a processor, memory, wireless communication circuitry, and an actuation sensor. The processor and memory located within the housing. A connector is included for electrically connecting to a power supply of the dispenser. The compliance module receives power from the dispenser. The processor determines a dispense event has occurred when it receives a signal from the actuation sensor. The processor causes the wireless communication circuitry to transmit a signal indicative of a dispense event.

An exemplary fluid dispenser having a removable compliance module includes an enclosure, a pump housing, a dispenser power supply, and a compliance module inserted in the dispenser. The compliance module includes a module housing, a processor, memory, a transceiver and voltage monitoring circuitry for detecting a change in voltage of the dispenser power supply. The processor, memory, transceiver and voltage monitoring circuitry are in circuit communication with one another and are located within the module housing. A connector is included for providing power to the compliance module circuitry from a power supply of the dispenser. The compliance module receives power from the dispenser. The processor determines a dispense event has occurred as a function of a change in a parameter, such as a voltage drop detected by the voltage monitoring circuitry and the processor causes the wireless communication circuitry to transmit a signal indicative of a dispense event.

Another exemplary compliance module for a fluid dispenser includes a housing, a processor, memory, wireless communication circuitry and wireless power transfer circuitry. The processor and memory are located within the module housing. The compliance module receives power from the dispenser through the wireless power transfer circuitry. The processor determines a dispense event has occurred when it receives a signal from the actuation sensor. The processor causes the wireless communication circuitry to transmit a signal indicative of a dispense event.

Exemplary embodiments of compliance modules, dispensers with compliance modules, and compliance systems are disclosed herein. An exemplary compliance module for a fluid dispenser includes a housing, wireless communication circuitry and a module connector for connecting to a dispenser connector. The connector includes one or more communication pins, a power pin, and a ground pin. The wireless communication circuitry receives signals from a processor in a dispenser to transmit a signal indicative of a dispense event, and the wireless communication circuitry receives power from a power supply located in the dispenser.

Another exemplary compliance module for a fluid dispenser includes a housing, wireless communication circuitry, and a module connector for connecting to a dispenser connector. The connector includes one or more pins for providing signals to, and receiving signals from, the wireless communication circuitry, a power pin and a ground pin for providing power to the wireless communication circuitry. The wireless communication circuitry receives signals from a dispenser processor in a dispenser to transmit a signal indicative of a dispense event and the wireless communication circuitry receives power from a power supply located in the dispenser when the module connector is connected to the dispenser connector.

An exemplary fluid dispenser having a removable compliance module includes an enclosure, a pump housing, a power supply, a processor, memory, a dispenser connector and a compliance module inserted in the dispenser. The compliance module includes wireless communication circuitry, a module connector and often a housing surrounding the communication circuitry. When the module connector is connected to the dispenser, the wireless communication circuitry is placed in circuit communication with the processor and the wireless communication circuitry receives power from the power supply.

An exemplary compliance module for a fluid dispenser includes a housing, a processor, memory, wireless communication circuitry and a power source for providing power to the processor and wireless communication circuitry. The processor, memory and power source are located within the housing. A module connector for connecting to a dispenser connector is also provided. The processor determines a dispense event has occurred as a function of a signal received through the module connector and the processor causes the wireless communication circuitry to transmit a signal indicative of a dispense event.

Another exemplary embodiment of a compliance module for a fluid dispenser includes a housing, a processor, memory, wireless communication circuitry, an actuation sensor and a power source. The processor, memory and power source are located within the housing. The processor determines a dispense event has occurred when it receives a signal from the actuation sensor and the processor causes the wireless communication circuitry to transmit a signal indicative of a dispense event.

An exemplary embodiment of a fluid dispenser having a removable compliance module includes an enclosure, a pump housing; and a compliance module inserted in the dispenser. The compliance module includes a housing, a processor, memory, a transceiver, and a power supply. The processor, memory, transceiver and power supply are in circuit communication with one another and are located within the housing. The processor determines a dispense event has occurred as a function of a signal provided to the processor and the processor causes the wireless communication circuitry to transmit a signal indicative of a dispense event.

BRIEF DESCRIPTION OF THE DRAWINGS

These and other features and advantages of the present invention will become better understood with regard to the following description and accompanying drawings in which.

DETAILED DESCRIPTION

Figure 1:
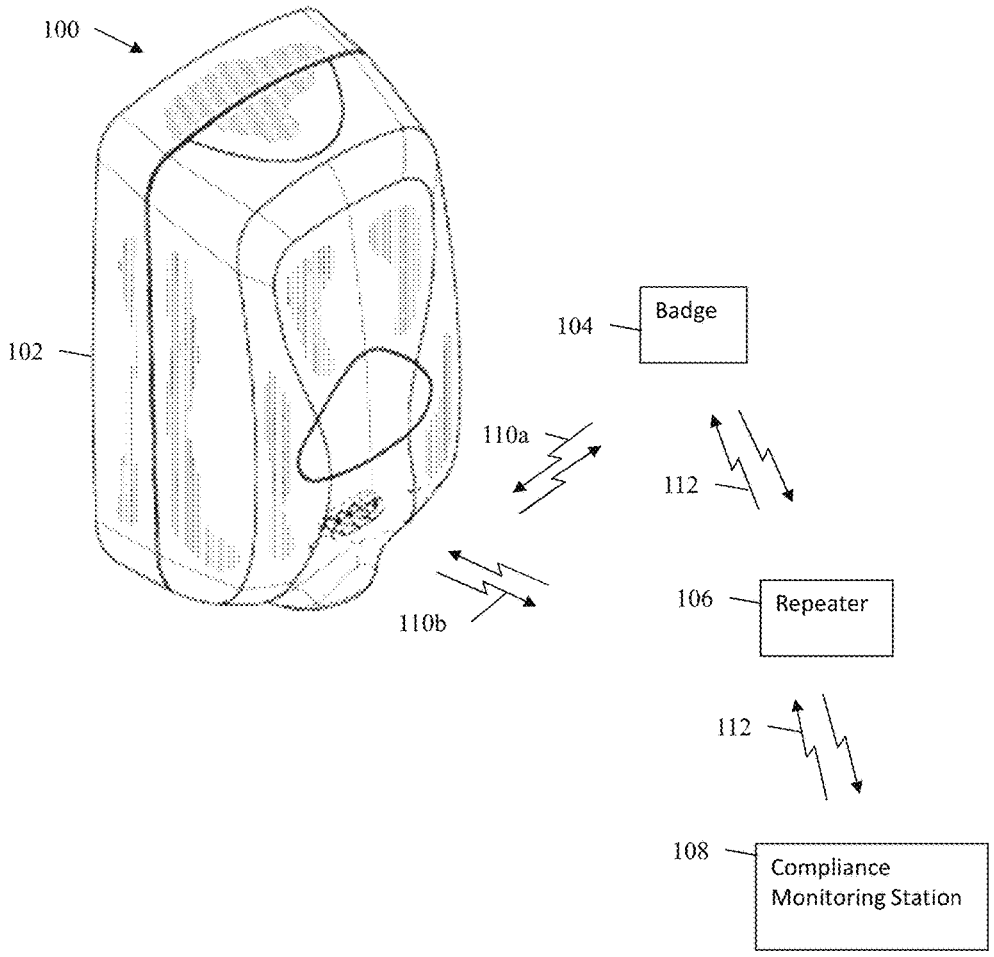
FIG. 1 is illustrative of a compliance monitoring system.

The following includes definitions of exemplary terms used throughout the disclosure. Both singular and plural forms of all terms fall within each meaning. Except where noted otherwise, capitalized and non-capitalized forms of all terms fall within each meaning:

"Circuit communication" as used herein indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication. Circuit communication includes providing power to one or more devices. For example, a processor may be in circuit communication with one or more batteries, indicating that the batteries provide power to the processor.

Also, as used herein, voltages and values representing digitized voltages are considered to be equivalent for the purposes of this application, and thus the term "voltage" as used herein refers to either a signal, or a value in a processor representing a signal, or a value in a processor determined from a value representing a signal.

"Signal", as used herein includes, but is not limited to one or more electrical signals, power signals, analog or digital signals, one or more computer instructions, a bit or bit stream, or the like.

"Logic," synonymous with "circuit" as used herein includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

The values identified in the detailed description are exemplary and they are determined as needed for a particular dispenser and/or refill design. Accordingly, the inventive concepts disclosed and claimed herein are not limited to the particular values or ranges of values used to describe the embodiments disclosed herein.

Power connection as used herein indicates a power relationship between devices. Direct electrical connections as well as inductive power connections are examples of circuit communication.

FIG. 1 illustrates an exemplary embodiment of compliance monitoring system 100. Compliance monitoring system 100 includes a plurality of dispensers 102 (only 1 is shown for clarity), a plurality of badges 104 (only 1 is shown for clarity), one or more repeaters 106 (in some instances repeaters 106 are not required) and a compliance monitoring station 108.

Dispenser 102 may be any type of dispenser, such as, for example, a touch free dispenser. Exemplary touch-fee dispensers are shown and described in U.S. Pat. No. 7,837,066 titled Electronically Keyed Dispensing System And Related Methods Utilizing Near Field Response; U.S. Pat. No. 9,172,266 title Power Systems For Touch Free Dispensers and Refill Units Containing a Power Source; U.S. Pat. No. 7,909,209 titled Apparatus for Hands-Free Dispensing of a Measured Quantity of Material; U.S. Pat. No. 7,611,030 titled Apparatus for Hans-Free Dispensing of a Measured Quantity of Material; U.S. Pat. No. 7,621,426 titled Electronically Keyed Dispensing Systems and Related Methods Utilizing Near Field Response; and U.S. Pat. No. 8,960,498 titled Touch-Free Dispenser with Single Cell Operation and Battery Banking; all which are incorporated herein by reference. In some embodiments, the dispenser may be a manually operated dispenser. In such a dispenser, a user manually causes the dispenser to dispense product. The user may manually cause the dispenser to dispense product by, for example, pressing a push-bar; pulling a lever; pushing a lever; steping on a foot activated pump; and the like.

Dispenser 102 is equipped with wireless communication circuitry, embodiments of which are described in more detail below. Dispenser 102 may communicate with a badge 104 carried by a user (not shown), and/or with the compliance monitoring station 108. In some embodiments, dispenser 102 transmits signals 110*a* to badge 104. In some embodiments badge 104 transmits signals 110*a* to dispenser 102. In some embodiments signals 110*a* are routed through one or more repeaters 106. In some embodiments, the signals are indicative of at least one of a dispenser function, a dispenser identification and a badge identification.

In some embodiments, dispenser 102 transmits signals 110*b* to compliance monitoring station 108. In some embodiments, dispenser 102 receives signals 110*b* from compliance monitoring station. In some embodiments, signals 110*b* are one-way signals from the dispenser 102 to the compliance monitoring station 108. In some embodiments, the signals are indicative of at least one of a dispenser function, a dispenser identification, a badge identification, a dispenser parameter, and the like. In some embodiment, the signals 110*b* are routed through one or more repeaters 106. In some embodiments, badge 102 transmits signals 112 to compliance monitoring station 108. In some embodiments, badge 102 receives signals 112 from compliance monitoring station. In some embodiments, the signals are indicative of at least one of a dispenser function, a dispenser identification, a badge identification, a dispenser parameter, and the like. In some embodiment, the signals 112 are routed through one or more repeaters 106. The dispenser functions may be indicative of, for example, a dispense event, a refill level, a dispenser error, an incorrect or unauthorized refill, a dispenser malfunction, or the like.

Figure 2:
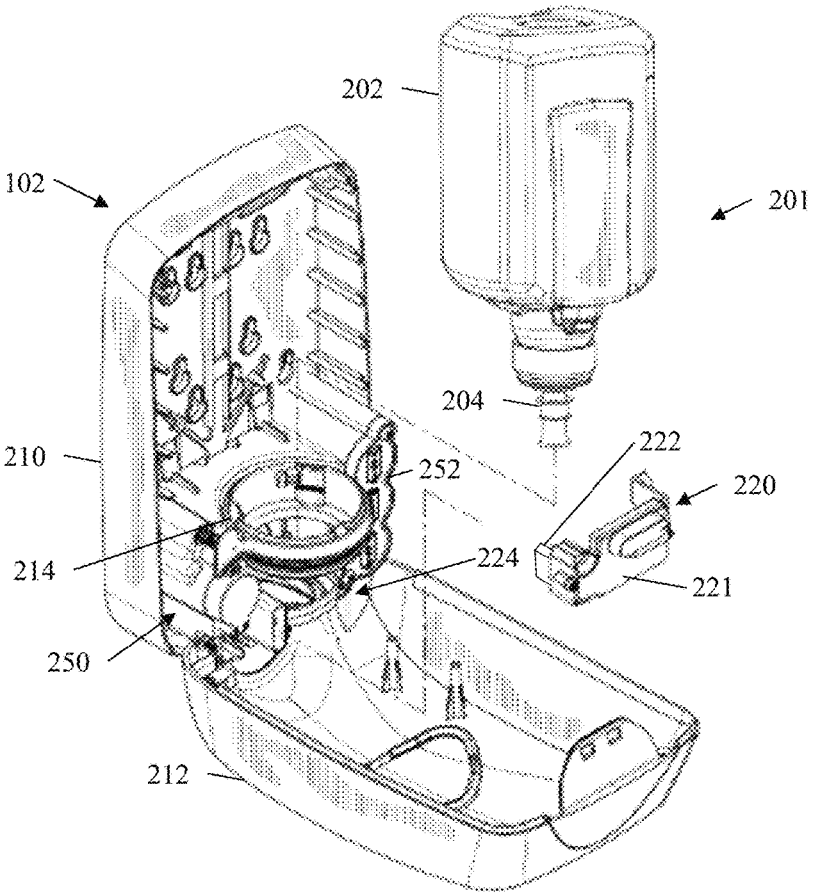
FIG. 2 is illustrative of a dispenser in an open position having a dispenser pump housing, a refill unit and an exemplary hygiene compliance module.

FIG. 2 is the exemplary dispenser 102 shown in an open position. Dispenser 102 includes a back housing 210 and a front housing 212, which form an enclosure. Front housing 212 is hingedly attached to back housing by a hinge (not shown) and is shown in the open position. Dispenser 102 includes a pump housing 250. Pump housing 250 includes a receptacle 214 for receiving refill unit 201. Refill unit 201 includes a container 202 for holding a fluid and a pump 204 for dispensing the fluid. In some embodiments, refill unit 201 contains a container and the pump is included with the pump housing 250.

A compliance module 220 is shown in FIG. 2. Compliance module 220 is shown generically and includes a housing 221, a connector 222. Housing 221 is configured to surround the circuitry described herein for performing the functions described herein and may take many forms. In this exemplary embodiment, compliance module 220 includes a connector 222 for connecting to a communication port 260 (shown in FIG. 3). In some embodiments, the connector 222 is secured to the housing 221. In some embodiments, connector 222 is coupled to the compliance module circuitry through one or more wires (not shown). In some exemplary embodiments, connector 222 may not be needed. In some exemplary embodiments, additional connectors may be included as described herein. In some exemplary embodiments, compliance module 220 may be connected to another connection point (not shown).

Figure 3:
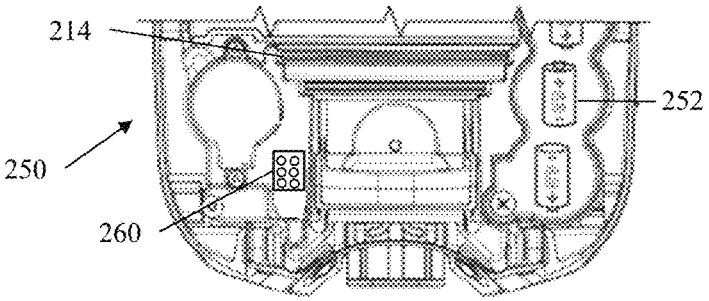
FIG. 3 is a front elevational view of the dispenser pump housing of FIG. 2.
Figure 4:
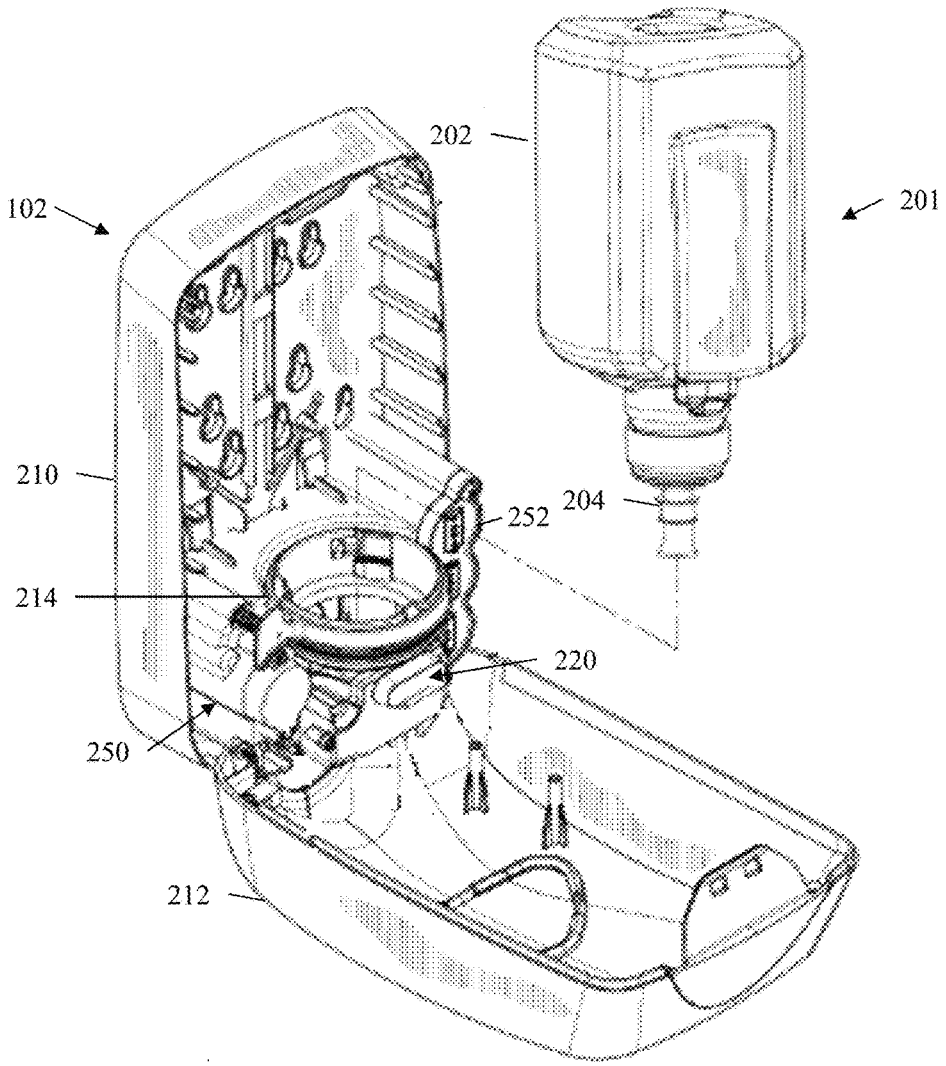
FIG. 4 is the dispenser of FIG. 2 with the hygiene compliance module inserted in the dispenser pump housing.

FIG. 3 is a partial front view of disperser 102 showing the pump housing 250, and connector 260. In some embodiments connector 260 is a communication port, in some embodiments connector 260 is a communication port with power, and in some embodiments, connector 260 contains power only. Pump housing 250 include dispenser power supply 252, which in this exemplary dispenser is a plurality of batteries. FIG. 4 is the exemplary dispenser 102 with the compliance module 220 coupled thereto.

Figure 5:
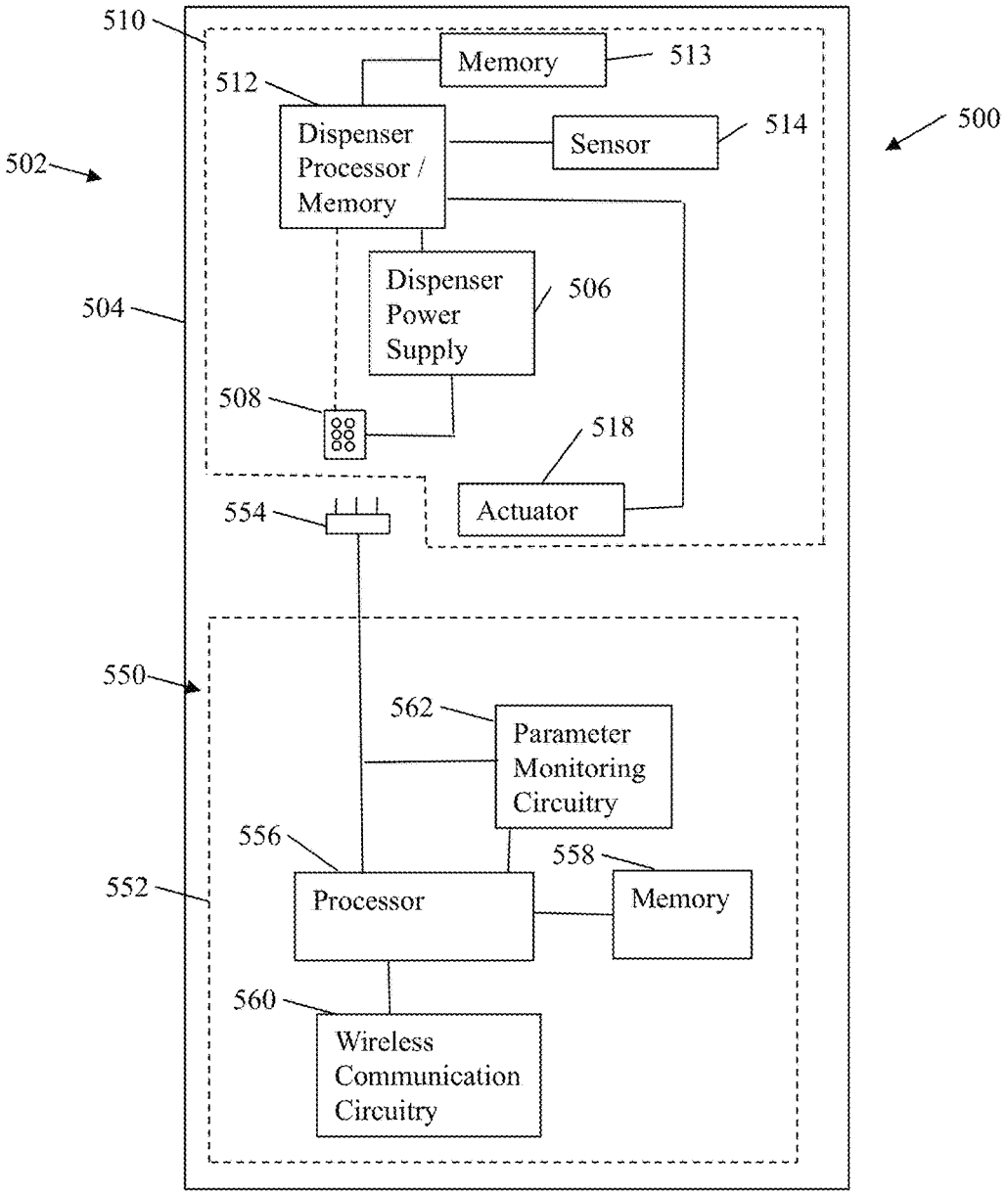
FIG. 5 is a schematic diagram of an exemplary dispenser with an exemplary hygiene compliance module powered by the dispenser and that detects a dispense function by monitoring the dispenser power.

FIG. 5 is a schematic diagram of an exemplary dispenser system 500 that includes a dispenser 502 that has a housing 504 and a compliance module 552. Dispenser 502 may be any of the types of dispensers described or incorporated herein. Dispenser 502 includes dispenser system circuitry 510. Many of the components of dispenser system circuitry 510 may be on a single circuit board or may be on multiple circuit boards. In addition, some of the circuitry may not be on a circuit board, but rather individually mounted and electrically connected to the other components as required. In this exemplary embodiment, dispenser system circuitry 510 includes a processor 512 and memory 513, a power source 506, which may include a voltage regulator (not shown), and an object sensor 142. Additional circuitry, such as, for example, end of stroke circuitry (not shown), actuator drive circuitry (not shown), may be included as necessary. Dispenser 600 includes an actuator 518. In some embodiments, actuator 518 includes components, such as, for example, actuation circuitry, a motor, gearing and an actuator for causing a dispense of fluid ("dispense event").

Processor 512 may be any type of processor, such as, for example, a microprocessor or microcontroller, discrete logic, such as an application specific integrated circuit (ASIC), other programmed logic device or the like. Processor 512 may be in circuit communication with a connector 508, which may be a connection port, which may be a communication port that allows a user to connect to dispenser system circuitry 510 to program the circuitry, run diagnostics on the circuitry and/or retrieve information from the dispenser system circuitry 510 depending on the dispenser configuration. In some embodiments, dispenser system circuitry 510 includes wireless transmitting/receiving logic and/or circuitry, such as for example, wireless RF, BlueTooth®, ANT®, or the like, configured to allow the above identified features to be conducted remotely.

Processor 512 is in circuit communication with memory 513. Memory 513 may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, magnetic disk or tape, optically readable mediums including CD-ROM and DVD-ROM, or the like, or combinations of different types of memory. In some embodiments, the memory 513 is separate from the processor 512, and in some embodiments, the memory 513 resides on or within processor 512.

A power source 506, such as, for example, one or more batteries, is also provided. The power source 506 is preferably designed so that the power source 506 does not need to be replaced for the life of the dispenser 502. The power source 506 is in circuit communication with voltage regulator circuitry (not shown). In one exemplary embodiment, voltage regulator circuitry (not shown) provides regulated power to processor 512, object sensor 514, and connector 508, which may be a communication port.

Processor 512 is in circuit communication with an object sensor 514 for detecting whether an object is present in the dispense area. Object sensor 514 may be any type of passive or active object sensor, such as, for example, an infrared sensor and detector, a proximity sensor, an imaging sensor, a thermal sensor or the like.

In addition, processor 512 is in circuit communication with actuator drive circuitry 518 (which may include a motor and gearing). Actuator drive circuitry 518 causes a motor and associated gearing (not shown) to operate a pump (not shown), such as, for example, the pump 204 shown in FIGS. 2 and 4).

Compliance module 550 includes a housing 552. Preferably housing 552 is configured to at least partially surround the compliance module circuitry described herein. In some embodiments, housing 552 is sealed all around the circuitry compliance module 550 to prevent moisture, soap, or the like from contacting the circuitry located therein. Compliance module 550 circuitry includes a processor 556. Processor 556 may be any type of processor, such as, for example, a microprocessor or microcontroller, discrete logic, such as an application specific integrated circuit (ASIC), other programmed logic device or the like as described above.

Compliance module 550 includes memory 558 in circuit communications with processor 556. Memory 558 may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, magnetic disk or tape, optically readable mediums including CD-ROM and DVD-ROM, or the like, or combinations of different types of memory. In some embodiments, the memory 558 is separate from the processor 556, and in some embodiments, the memory 558 resides on or within processor 556.

Processor 556 is in circuit communication with parameter monitoring circuitry 562. parameter monitoring circuitry 562 monitors an electrical parameter of dispenser 600. In some embodiments, the parameter monitoring circuitry 562 monitors voltage, in some embodiments, the parameter monitoring circuitry 562 monitors voltage; in some embodiments, the parameter monitoring circuitry 562 monitors current; in some embodiments, the parameter monitoring circuitry 562 monitors capacitance; in some embodiments, the parameter monitoring circuitry 562 monitors a field, such as, for example, a magnetic field.

Processor 556 is in circuit communication with wireless communication circuitry 560. Wireless communication circuitry 560 may include hardware, software and/or logic and may be, for example, wireless transmitting circuitry, wireless transmitting/receiving circuitry, wireless RF circuitry, BlueTooth®, ANT®, any necessary hardware, software, or the like, configured to allow the compliance module 550 to communicate with one or more badges (not shown), and/or one or more repeaters (not shown) and/or one or more compliance monitoring stations (not shown).

In addition, processor 556 is in circuit communication with connector 554. Connector 554 connects to connector 508, which may be a power port, a communication port of the dispenser, or the like. When connector 554 is connected to connector 508, the compliance module receives power from the dispenser power supply 506. In this exemplary embodiment, dispenser power supply 506 is one or more batteries. In some embodiments, connector 508 connects directly to one or more batteries. Processor 556 is in circuit communication with voltage monitoring circuitry 562.

During operation, when the processor 512, through object sensor 514, determines that an object is within the dispense zone, the processor 512 causes the actuator drive circuitry 518 to operate the pump (not shown). When dispenser processor 512 causes actuation drive circuitry 518 to dispense a dose of fluid, there is a current draw on the dispenser power supply 506. The current draw causes a momentary change in voltage, for example, a "drop" in voltage, of the dispenser power supply 506. In some embodiments, the actuation causes a capacitance; and in some embodiments, actuation causes a magnetic field.

In some exemplary embodiment, parameter monitoring circuitry 562 monitors the dispenser power supply 506 voltage for a voltage drop. In some embodiments, if the voltage drops below a set threshold, processor 556 determines that a dispense event has occurred. The threshold may be a percentage of the remaining power in the dispenser, it may be a set voltage drop. In addition, the parameter monitoring circuitry 562 may include delay circuitry that may be set to insure only one dispense event is indicated even though the indicative parameter is detected two or more times during a single dispense event. In some embodiments, parameter monitoring circuitry 562 similarly monitors or detects a current draw, a magnetic field or a capacitance. Although the term "parameter monitoring" is used, there is no need for continuously monitoring, and in some embodiments parameter monitoring simply means parameter detection.

When parameter monitoring circuitry 562 indicates a dispense event, processor 556 causes wireless communication circuitry 560 to transmit a signal indicative of the dispense event. As described above, the transmission may be directed to a badge (not shown), a repeater (not shown), a compliance monitoring station or the like. In some embodiments, a badge (not shown) transmits an identification signal to the compliance module and the processor 556 receives the signal and transmits both a dispense event and a badge identification signal to the monitoring station, either directly or through one or more intermediate devices.

In some embodiments, connector 508 is connected only to the dispenser power supply 506. In some embodiments, connectors 554 and 508 are not used and compliance module 550 is otherwise placed in circuit communication with or more of the batteries in the dispenser power supply.

Figure 6:
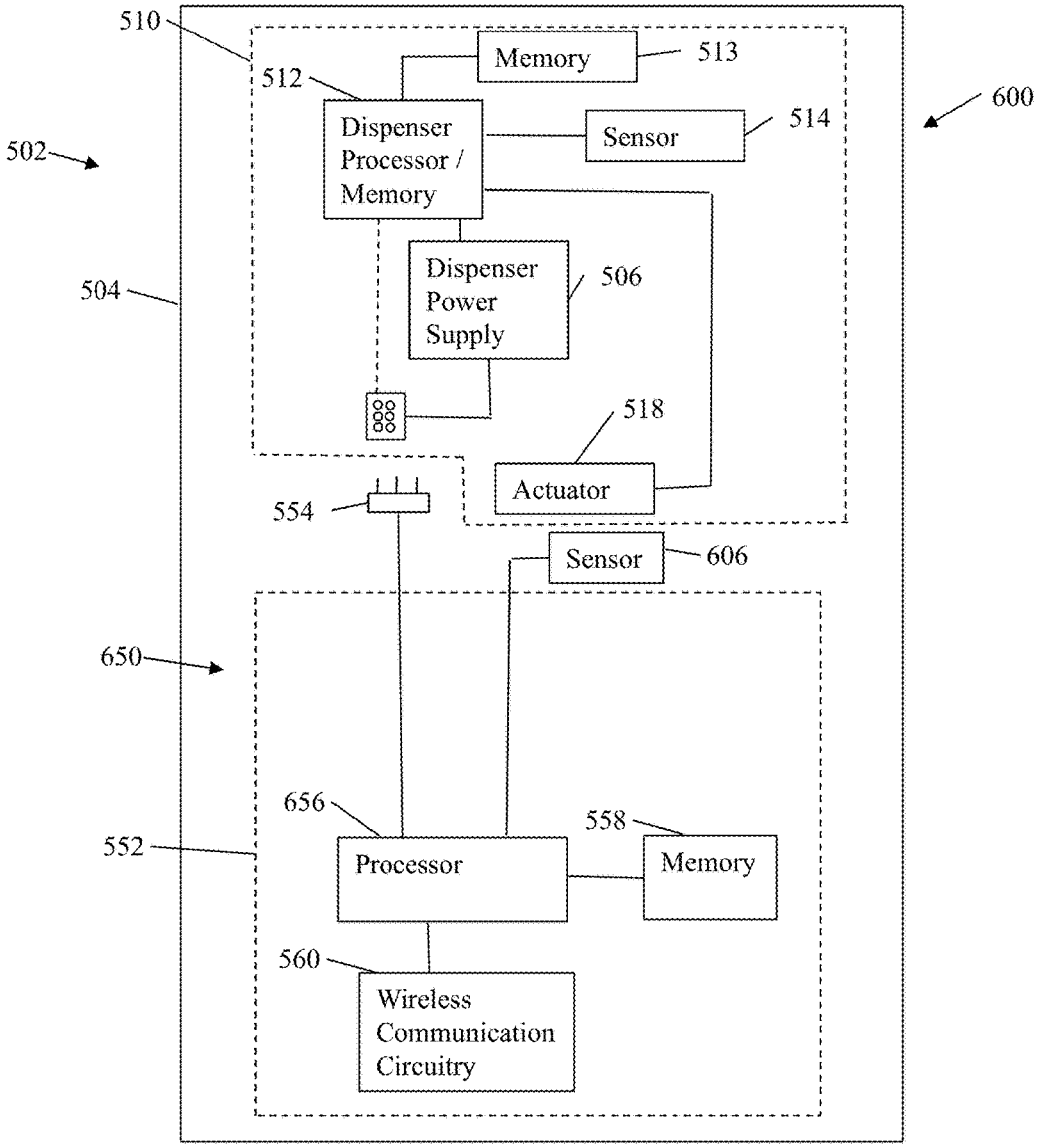
FIG. 6 is schematic diagram of an exemplary dispenser with an exemplary hygiene compliance module powered by the dispenser that detects a dispense function by monitoring actuation of the the actuator.

FIG. 6 illustrates another exemplary embodiment of a dispenser system 600. Dispenser system 600 has many components that are similar to dispenser system 500 and like numbered components are not re-described herein. Compliance module 650 does not require parameter monitoring circuitry. Rather compliance module 650 includes a sensor 606 in circuit communication with processor 656. Processor 656 is similar to processor 556 described above but has an input for receiving a signal from sensor 606. In some exemplary embodiments, sensor 606 detects movement or motion of a component of the actuator drive and provides a signal to processor 656 that is indicative of a dispense event. In some exemplary embodiments, sensor 606 senses a dispenser function, such as, for example, sensor 606 may detect a light on the dispenser that is indicative of a dispense event, a sound on the dispenser that is indicative of a dispense event. The sound may be a sound that the dispenser intentionally creates, or the sound caused by energizing the motor, moving the actuator, moving the pump or the like Exemplary sensors include, a switch, a proximity sensor, a light detector, an audible detector, a vibration detector, a magnetic sensor with a magnet on the actuator or sensor, a hall effect sensor, and the like. Once a dispense event has occurred, processor 656 causes one or more signals to be transmitted as described above.

Figure 7:
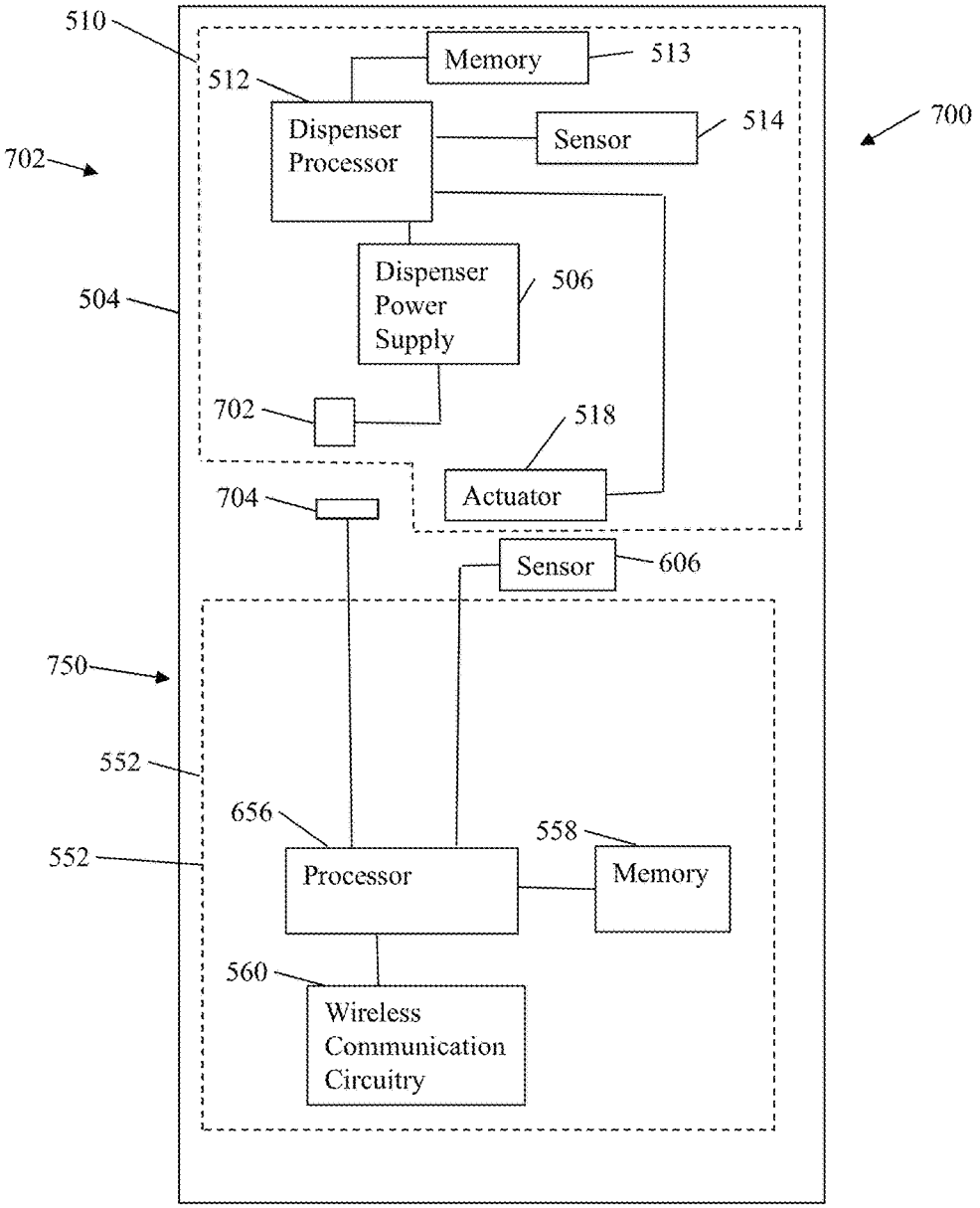
FIG. 7 is schematic diagram of an exemplary dispenser with an exemplary hygiene compliance module powered by the dispenser that detects a dispense function by monitoring the actuation of the actuator.

FIG. 7 is another exemplary embodiment of a dispenser system 700 that includes a dispenser 702. Many of the components of dispenser system 700 are similar to those of dispenser system 600 and like parts are not re-described herein. Compliance module 750 is inductively powered by dispenser power supply 506 through wireless power transfer circuitry or wireless energy transmission circuitry. In an exemplary embodiment, the wireless power transfer circuitry transfers power through magnetic fields using inductive coupling. In this exemplary embodiment, transmitter circuitry 702 is in circuit communication with dispenser power supply 506. Transmitter circuitry 702 converts the power to a time-varying electromagnetic field. Receiver circuitry 704 receives the power from the time-varying electromagnetic field and converts it back to DC current. Receiver circuitry 704 provides the power to the wireless processor 656, wireless communication circuitry 560 and any other components in module 750. In some embodiments, a power storage device, such as a rechargeable battery or capacitor (not shown) is included in the module circuitry 552 to store power required for the module circuitry 552.

Figure 8:
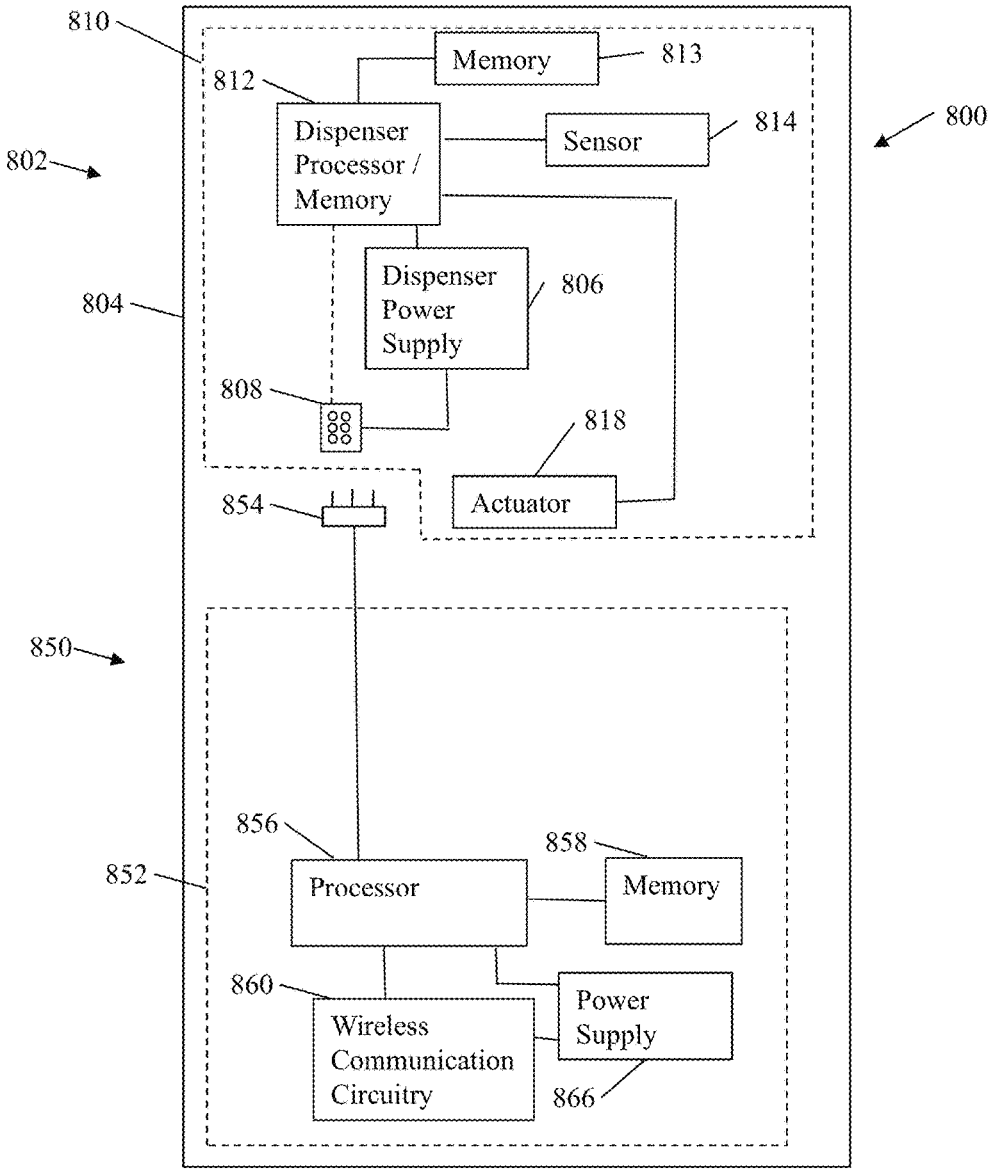
FIG. 8 is a schematic diagram of an exemplary dispenser with an exemplary hygiene compliance module that detects a dispense function by monitoring the dispenser power.

FIG. 8 is a schematic diagram of an exemplary dispenser system 800 that includes a dispenser 802 that has a housing 804 and a compliance module 852. Dispenser 802 may be any of the dispensers described and/or incorporated herein. Dispenser 802 includes dispenser system circuitry 810. Some of the components of dispenser system circuitry 810 may be on a single circuit board or may be on multiple circuit boards. In addition, some of the circuitry may not be on a circuit board, but rather individually mounted and electrically connected to the other components as required. In this exemplary embodiment, dispenser system circuitry 810 includes a processor 812 and memory 813, a power source 806, which may include a voltage regulator (not shown) and an object sensor 142. Additional circuitry, such as, for example, end of stroke circuitry (not shown), actuator drive circuitry (not shown), may also be included. Dispenser circuitry 810 includes an actuator 818. In some embodiments, actuator 818 may include one or more of actuation circuitry, a motor, gearing and an actuator for causing a dispense of fluid ("dispense event").

Processor 812 may be any type of processor, such as, for example, a microprocessor or microcontroller, discrete logic, such as an application specific integrated circuit (ASIC), other programmed logic device or the like. Processor 812 may be in circuit communication with a connector 808, which may be a connection port, which may be a communication port that allows a user to connect to dispenser system circuitry 810 to program the circuitry, run diagnostics on the circuitry and/or retrieve information from the dispenser system circuitry 810 depending on the dispenser configuration. In some embodiments, dispenser system circuitry 810 includes wireless transmitting/receiving logic and/or circuitry, such as for example, wireless RF, BlueTooth®, ANT®, or the like, configured to allow the above identified features to be conducted remotely.

Processor 812 is in circuit communication with memory 813. Memory 813 may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, magnetic disk or tape, optically readable mediums including CD-ROM and DVD-ROM, or the like, or combinations of different types of memory. In some embodiments, the memory 813 is separate from the processor 812, and in some embodiments, the memory 813 resides on or within processor 812.

A power source 806, such as, for example, one or more batteries, is also provided. The power source 806 is preferably designed so that the power source 806 does not need to be replaced for the life of the dispenser 802. The power source 806 is in circuit communication with voltage regulator circuitry (not shown). In some exemplary embodiments, voltage regulator circuitry (not shown) provides regulated power to processor 812, object sensor 814, and connector 808, which may be a communication port.

Processor 810 is in circuit communication with an object sensor 814 for detecting whether an object is present in the dispense area. Object sensor 814 may be any type of passive or active object sensor, such as, for example, an infrared sensor and detector, a proximity sensor, an imaging sensor, a thermal sensor or the like.

In addition, processor 812 is in circuit communication with actuator drive circuitry 818 (which includes may include a motor and gearing). Actuator drive circuitry 818 causes a motor and associated gearing (not shown) to operate a pump (not shown), such as, for example, the pump 204 shown in FIGS. 2 and 4).

Compliance module 850 includes a housing 852. Preferably housing 852 is configured to at least partially surround the compliance module circuitry described herein. In some embodiments, housing 852 entirely surrounds the module circuitry. In some embodiments, housing 852 prevents water, soap and sanitizer from contacting module circuitry. Compliance module 850 circuitry includes a processor 856. Processor 856 may be any type of processor, such as, for example, a microprocessor or microcontroller, discrete logic, such as an application specific integrated circuit (ASIC), other programmed logic device or the like as described above.

Compliance module 850 includes memory 858 in circuit communications with processor 856. Memory 858 may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, magnetic disk or tape, optically readable mediums including CD-ROM and DVD-ROM, or the like, or combinations of different types of memory. In some embodiments, the memory 858 is separate from the processor 856, and in some embodiments, the memory 858 resides on or within processor 856.

Processor 856 is in circuit communication with wireless communication circuitry 860. Wireless communication circuitry 860 may include hardware, software and/or logic and may be, for example, wireless transmitting circuitry, wireless transmitting/receiving circuitry, wireless RF circuitry, BlueTooth®, ANT®, any necessary hardware, software, or the like, configured to allow the compliance module 850 to communicate with one or more badges (not shown), and/or repeaters (not shown) and/or one or more compliance monitoring stations.

In addition, processor 856 is in circuit communication with connector 854. Connector 854 connects to connector 808, which may be a power port, a communication port of the dispenser, or other connection port. When connector 854 is connected to connector 808, the compliance module receives a signal that is indicative of a dispenser function, such, as, for example, a dispense event.

Compliance module 850 includes a power supply 866 that provides power to the electrical components located in compliance module 850, such as, for example, processor 856 and wireless communication circuitry 860. In some embodiments, the power supply is a battery. In some embodiments, the power supply is a lithium battery. In some embodiments, the battery is a coin cell battery; in some embodiments, the battery is a size "AA" battery, in some embodiment the battery is a size "AAA" battery.

During operation, when processor 812, through object sensor 814, determines that an object is within the dispense zone, the processor 812 causes the actuator drive circuitry 818 to power the to operate the pump (now shown). When dispenser processor 812 causes actuation drive circuitry 818 to dispense a dose of fluid, there is signal indicative of a dispense event transmitted to a pin on connector 808 that is transmitted to processor 856 as connector 854 places processor 856 in circuit communication with the pin receiving the signal.

Processor 856 causes wireless communication circuitry 860 to transmit a signal indicative of the dispense event. As described above, the transmission may be directed to a badge (not shown), a repeater (not shown), a compliance monitoring station or the like. In some embodiments, a badge (not shown) transmits an identification signal to the compliance module and the processor 856 receives the signal and transmits both a dispense event and a badge identification signal to the monitoring station, either directly or through one or more intermediate devices.

Figure 9:
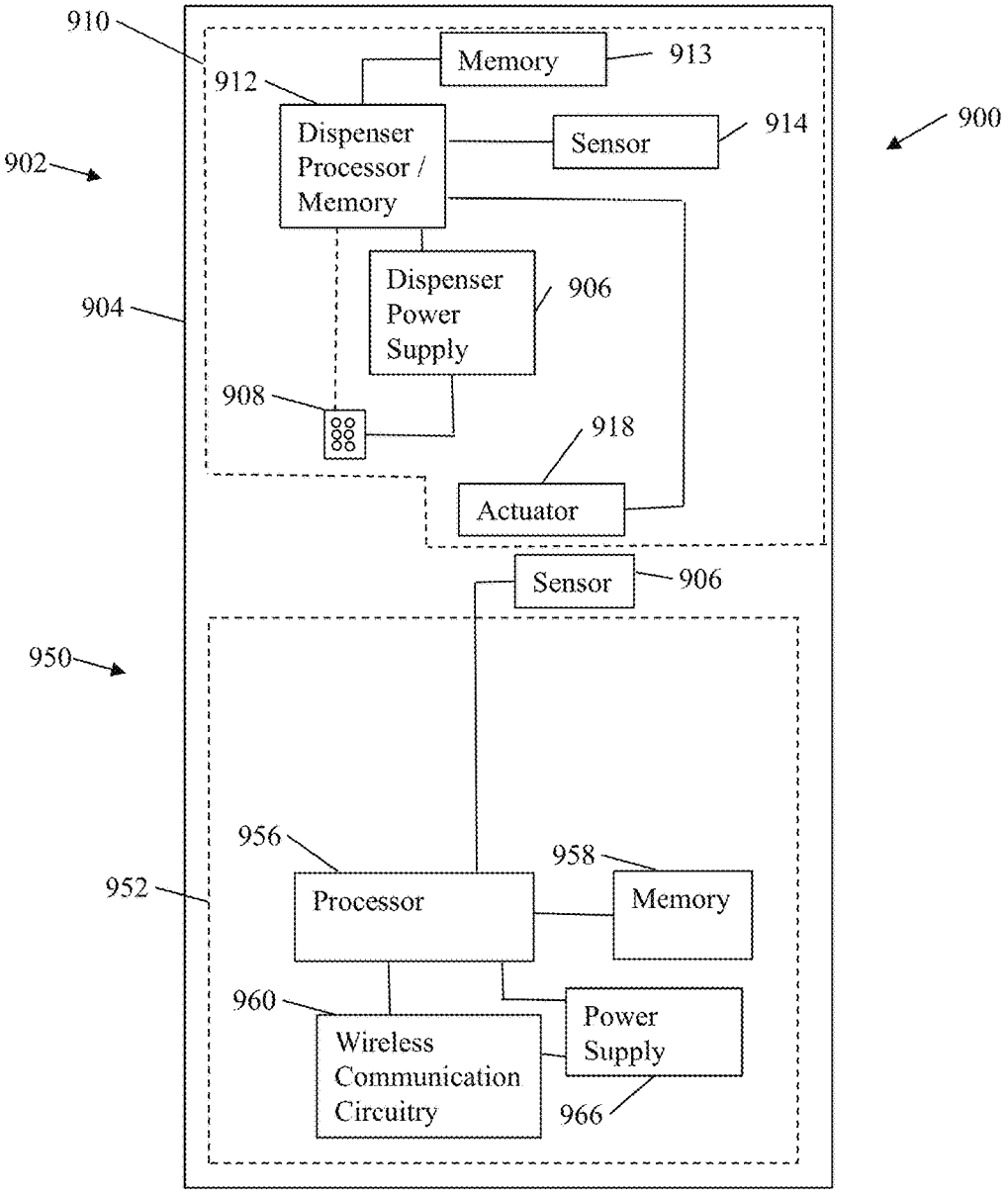
FIG. 9 is schematic diagram of an exemplary dispenser with an exemplary hygiene compliance module that detects a dispense function by monitoring the actuation of an actuator.

FIG. 9 illustrates another exemplary embodiment of a dispenser system 900. Dispenser system 900 has many components that are similar to dispenser system 500 and like numbered components are not re-described herein. Compliance module 950 does not connect to connector 508. Rather compliance module 950 includes a sensor 906 in circuit communication with processor 956. Processor 956 is similar to processor 856 described above but has an input for receiving a signal from sensor 906. In some exemplary embodiments, sensor 606 detects movement of a component of the actuator drive and provides a signal to processor 656 that is indicative of a dispense event. In some exemplary embodiments, sensor 606 senses a dispenser function, such as, for example, a light that is indicative of a dispense event, a sound that is indicative of a dispense event and any of the parameters disclosed with respect to the previous embodiments. Exemplary sensors include, a switch, a proximity sensor, a light detector, an audible detector, a vibration detector, a hall-effect sensor, a magnetic field sensor, a capacitance sensor, and the like. Once a dispense event has occurred, processor 656 causes one or more signals to be transmitted as described above.

Figure 10:
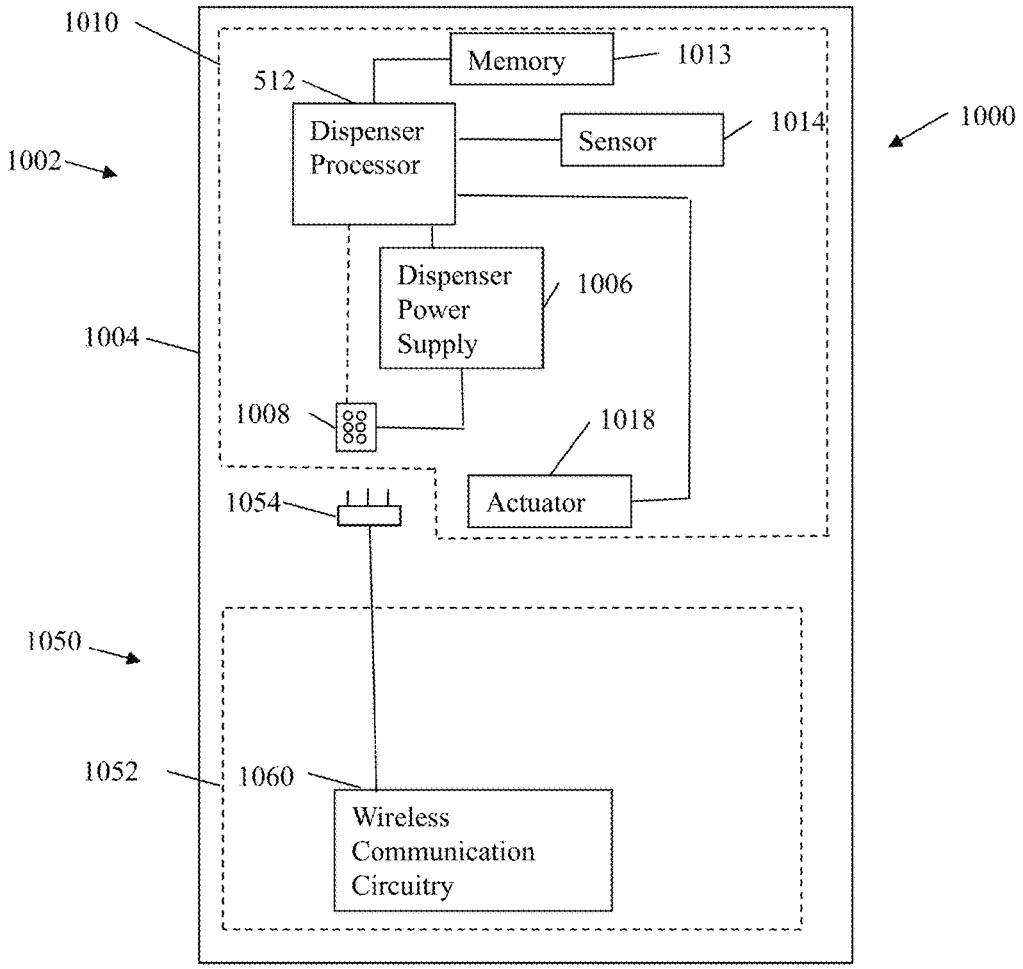
FIG. 10 is a schematic diagram of an exemplary dispenser with an exemplary hygiene compliance module.

FIG. 10 is a schematic diagram of an exemplary dispenser system 500 that includes a dispenser 1002 that has a housing 1004 and a compliance module 1052. Dispenser 1002 may be any of the dispensers described herein. Dispenser 1002 includes dispenser system circuitry 1010. Many of the components of dispenser system circuitry 1010 may be on a single circuit board or may be on multiple circuit boards. In addition, some of the circuitry may not be on a circuit board, but rather individually mounted and electrically connected to the other components as required. In this exemplary embodiment, dispenser system circuitry 1010 includes a processor 1012 and memory 1013, a power source 1006, which may include a voltage regulator (not shown) and an object sensor 142. Additional circuitry, such as, for example, end of stroke circuitry (not shown), actuator drive circuitry (not shown), may also be included. Dispenser circuitry 1010 includes an actuator 1018. In some embodiments, actuator 1018 includes actuation circuitry, a motor, gearing and an actuator for causing a dispense of fluid ("dispense event").

Processor 1012 may be any type of processor, such as, for example, a microprocessor or microcontroller, discrete logic, such as an application specific integrated circuit (ASIC), other programmed logic device or the like. Processor 1012 is in circuit communication with a connector 1008 which is a communication port that allows a user to connect to dispenser system circuitry 1010 to program the circuitry, run diagnostics on the circuitry and/or retrieve information from the dispenser system circuitry 1010 depending on the dispenser configuration.

Processor 1012 is in circuit communication with memory 1013. Memory 1013 may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, magnetic disk or tape, optically readable mediums including CD-ROM and DVD-ROM, or the like, or combinations of different types of memory. In some embodiments, the memory 1013 is separate from the processor 1012, and in some embodiments, the memory 1013 resides on or within processor 1012.

A power source 1006, such as, for example, one or more batteries, is also provided. The power source 1006 is preferably designed so that the power source 1006 does not need to be replaced for the life of the dispenser 1002. The power source 1006 is in circuit communication with voltage regulator circuitry (not shown). In one exemplary embodiment, voltage regulator circuitry (not shown) provides regulated power to processor 1012, object sensor 1014, and connector 1008, which may be a communication port.

Processor 1010 is in circuit communication with an object sensor 1014 for detecting whether an object is present in the dispense area. Object sensor 1014 may be any type of passive or active object sensor, such as, for example, an infrared sensor and detector, a proximity sensor, an imaging sensor, a thermal sensor or the like.

In addition, processor 1012 is in circuit communication with actuator drive circuitry 1018 (which includes may include a motor and gearing). Actuator drive circuitry 1018 causes a motor and associated gearing (not shown) to operate a pump (not shown), such as, for example, the pump 204 shown in FIGS. 2 and 4).

Compliance module 1050 includes a housing 1052. Preferably housing 1052 is configured to at least partially surround the compliance module circuitry described herein. In some embodiments, housing 1052 completely surrounds the compliance module circuitry. IN some embodiments, housing 1052 prevents water, soap and sanitizer from contacting the electrical components located within housing 1052. Compliance module 1050 circuitry includes wireless communication circuitry 1060. Wireless communication circuitry 1060 may include hardware, software and/or logic and may be, for example, wireless transmitting circuitry, wireless transmitting/receiving circuitry, wireless RF circuitry, BlueTooth®, ANT®, any necessary hardware, software, or the like, configured to allow the compliance module 1050 to communicate with one or more badges (not shown), and/or repeaters (not shown) and/or one or more compliance monitoring stations.

In addition, wireless communication circuitry is in circuit communication with connector 1054. Connector 1054 connects to connector 1008. When connector 1054 is connected to connector 1008, processor 1012 is in circuit communication with wireless communication circuitry 1060. In addition, connector 1054 provides power to the wireless communication circuitry.

In some exemplary embodiments, the compliance module contains different wireless communication circuits that are capable of working with the different compliance monitoring system providers. For example, provider A may require wireless communication circuit J while provider B may require wireless communication circuit K. Wireless communication circuit J may require communication protocol X while wireless communication circuit K may require communication protocol Y. In some embodiments, the circuitry is the same, however different logic is used for the various wireless communication circuits.

In such embodiments, a user may connect to the communication port 1008 and download new (or an update) logic/software to the dispenser processor 1012 and or memory 1013 that is configured to communicate with the wireless communication circuitry 1060 that is used with the compliance monitoring system provider's network.

In some embodiments, a dispenser provider need only manufacture and stock one dispenser that has a communication port and a compliance module. Thus, a single dispenser model may be used without a compliance module in which case no logic/software update or reprogramming is needed, or may be updated to work with whatever module/module software is required by the compliance monitoring system provider.

During operation, when processor 1012, through object sensor 1014, determines that an object is within the dispense zone, the processor 1012 causes the actuator drive circuitry 1018 to power the to operate the pump (now shown). When dispenser processor 1012 causes actuation drive circuitry 1018 to dispense a dose of fluid, there is signal indicative of a dispense event transmitted to a pin on connector 1008 that is transmitted to processor 1056 as connector 1054 places processor 1056 in circuit communication with the pin receiving the signal.

Processor 1012 causes wireless communication circuitry 1060 to transmit a signal indicative of the dispense event. As described above, the transmission may be directed to a badge (not shown), a repeater (not shown), a compliance monitoring station or the like. In some embodiments, a badge (not shown) transmits an identification signal to the compliance module and the processor 1012 receives the signal and transmits both a dispense event and a badge identification signal to the monitoring station, either directly or through one or more intermediate devices.

As discussed above, wireless communication circuitry 1060 may receive signals from one or more badges that identify the badges and transmit the signal to processor 1012 or from a compliance monitoring station.

Figure 11:
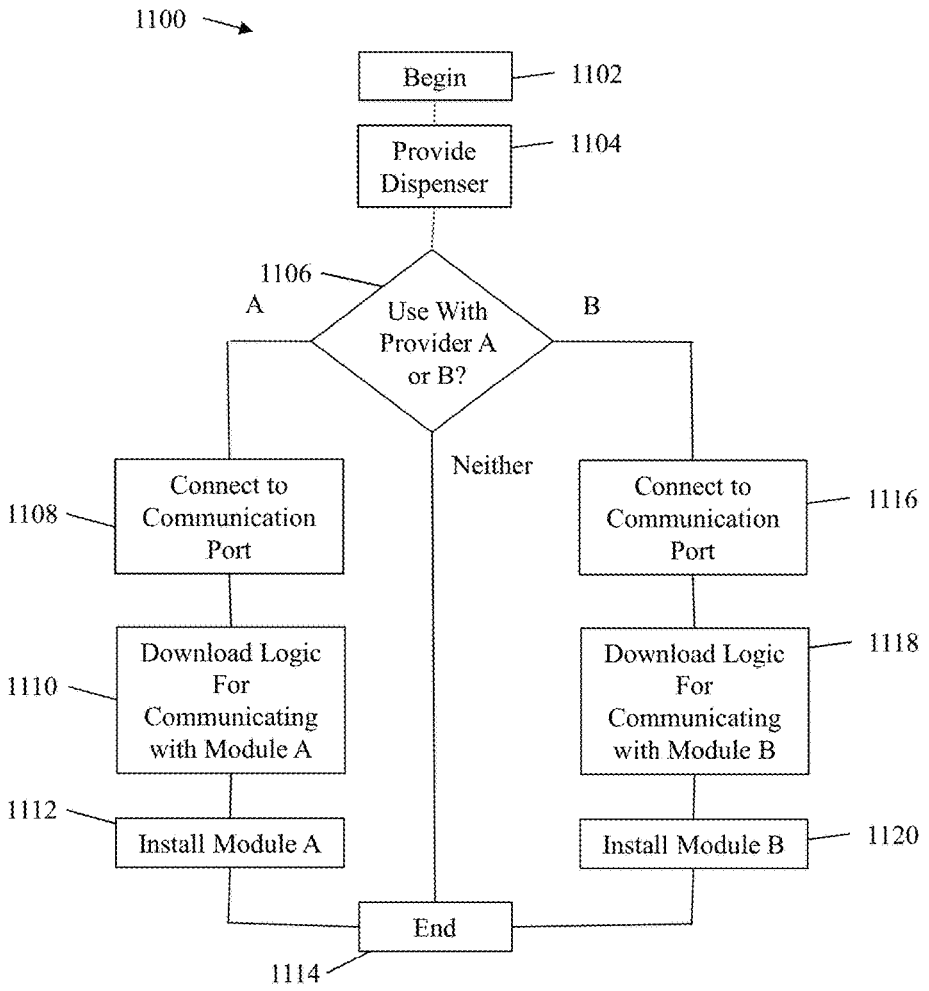
FIG. 11 is an exemplary methodology of providing a configurable dispenser for use with modules having different wireless communication circuitry.

FIG. 11 is an exemplary methodology 1100 of providing a configurable dispenser for use with a plurality of different modules having different wireless communication circuitry. The exemplary methodology begins at block 1102 and a dispenser is provided at block 1104. At block 1106 a determination is made as to whether the dispenser is to be used with Provider A, Provider B or neither. If the dispenser is not being used with either provider, the process ends at block 1114.

If at block 1106 a determination is made that the dispenser will be used with Provider A, a connection is made to the communication port of the dispenser by a cable in circuit communication with a programming device, such as for example, a computer at block 1108. Communication logic for allowing the dispenser to communication with Module A is downloaded into the memory of the dispenser at block 1110. At block 1112 Module A is installed in the dispenser and the dispenser/module A are tested for proper operation and the methodology ends at block 1114.

If at block 1106 a determination is made that the dispenser will be used with Provider B, a connection is made to the communication port of the dispenser by a cable in circuit communication with a programming device, such as for example, a computer at block 1116. Communication logic for allowing the dispenser to communication with Module B is downloaded into the memory of the dispenser at block 1118. At block 1120 Module B is installed in the dispenser and the dispenser/Module B are tested for proper operation and the methodology ends at block 1114.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. It is not the intention of the applicant to restrict or in any way limit the scope of the appended claims to such detail. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order in which the steps are presented to be construed as required or necessary unless expressly so stated.

We claim:

1. A compliance module for a touch-free fluid dispenser, the compliance module comprising:

a module housing;

a connector on the housing for releasably connecting to a communication port of the touch-free fluid dispenser and placing the compliance module in circuit communication with the touch-free fluid dispenser that contains a touch-free fluid dispenser power supply;

a module power supply located at least partially within the module housing and electrically separated from the touch-free fluid dispenser power supply in the touch-free fluid dispenser when the compliance module is connected to the dispenser through the communication port;

a processor;

a memory;

a wireless communication circuitry;

a parameter monitoring circuitry for detecting a change in an electrical parameter indicative of a dispense event;

wherein the processor, memory and parameter monitoring circuitry are located within the module housing;

and wherein the processor determines a dispense event has occurred as a function of a change in an electrical parameter in the touch-free dispenser circuitry is detected by the parameter monitoring circuitry through the connector;

and wherein the processor causes the wireless communication circuitry to transmit a signal indicative of a dispense event; and wherein the module housing is configured to fit within a housing that contains the touch-free fluid dispenser housing components.

2. The compliance module of claim 1 wherein the parameter change is a change in voltage.

3. The compliance module of claim 1 wherein the parameter change is a change in current.

4. The compliance module of claim 1 wherein the processor causes the wireless communication circuitry transmits a signal indicative of a dispense event and a badge identification.

5. A touch-free fluid dispenser having a removable compliance module comprising:

a touch-free dispenser enclosure;

a pump housing;

a first battery for powering the touch-free dispenser;

a communications port; and a compliance module removably inserted in the dispenser enclosure;

the compliance module including:

a module housing;

a connector for connecting to the communications port;

a module processor;

a second battery for powering the compliance module;

a memory;

a wireless communications circuitry; and a parameter monitoring circuitry for detecting a signal through the communications port;

wherein the processor, memory, wireless communications circuitry and parameter monitoring circuitry are in circuit communication with one another and are located within the module housing;

wherein the compliance module receives power from the second battery in the dispenser; and wherein the processor determines a dispense event has occurred as a function of a signal from the communications port;

and wherein the processor causes the wireless communication circuitry to transmit a signal indicative of a dispense event; and wherein the module housing is located within the dispenser enclosure.

6. The fluid dispenser of claim 5 wherein the electrical parameter detected by the monitoring circuitry is a drop in voltage.

7. The fluid dispenser of claim 5 wherein the processor causes the wireless communication circuitry transmits a signal indicative of a dispense event and a badge identification.

8. The fluid dispenser of claim 7 wherein the connector connects to a communication port of a dispenser.

9. The fluid dispenser of claim 5 wherein the connector connects to one or more batteries in the dispenser.

10. The fluid dispenser of claim 5 further comprising a refill unit containing a fluid to be dispensed.

11. A dispenser comprising:

a dispenser enclosure;

a receptacle for receiving a container for a fluid product;

an actuator for actuating a pump to pump the fluid product;

a first power supply located within the dispenser for providing power to the dispenser;

a dispenser processor for controlling the dispenser;

the dispenser processor powered by the first power supply;

a communication port in circuit communication with the processor;

a module housing;

a connector secured to the module housing for releasably connecting to the communication port of a fluid dispenser;

a second power supply located in the module housing;

a module processor powered by the second power supply;

a memory;

a wireless communication circuitry;

wherein the, module processor and memory and at least a portion of the wireless communication circuitry are located within the module housing;

wherein the processor receives a signal from the dispenser that is indicative of a dispense event from the dispenser; and wherein the processor and wireless communication circuitry are powered from the second power supply; and wherein the second power supply in the module is separate from the first power supply in the dispenser; and wherein the module housing is located within the dispenser enclosure.

* * * * *